US005195196A

United States Patent [19]

Johenning et al.

[11] Patent Number: 5,195,196

[45] Date of Patent: Mar. 23, 1993

[54] SCULPTURED, STRETCHABLE WATERBED MATTRESS WITH AESTHETIC APPEARANCE

[75] Inventors: John B. Johenning, Los Angeles; Charles P. Hall, Santa Rosa, both of Calif.

[73] Assignee: Land and Sky Manufacturing, Inc., Lincoln, Nebr.

[21] Appl. No.: 717,461

[22] Filed: Jun. 24, 1991

Related U.S. Application Data

[63] Continuation of Ser. No. 810,081, Dec. 17, 1985, which is a continuation-in-part of Ser. No. 591,013, Mar. 19, 1984, Pat. No. 4,583,254.

[51] Int. Cl.[5] ..... A47C 27/08

[52] U.S. Cl. ..... 5/451; 5/464

[58] Field of Search ..... 5/451, 450, 452, 449, 5/455, 422, 644, 919, 464

[56] References Cited

U.S. PATENT DOCUMENTS 3,456,270 7/1969 Weinstein et al. ..... 5/451
3,849,814 11/1974 Ross ..... 5/451
4,534,078 8/1985 Viesturs et al. ..... 5/451

*Primary Examiner*—Alexander Grosz
*Attorney, Agent, or Firm*—Oblon, Spivak, McClelland, Maier & Neustadt

[57] ABSTRACT

A waterbed mattress including an elongated top sheet having head and foot ends, a bottom sheet, and sidewalls defining a fluid-tight receptacle. The top sheet includes a plurality of elongated depressions and riser portions formed therein and arranged to impart extensibility to the top sheet. The depressions and riser portions are arranged in a non-uniform distribution across the surface of the top sheet so that the extensibility of the top sheet varies at different positions therealong.

29 Claims, 6 Drawing Sheets

SCULPTURED, STRETCHABLE WATERBED MATTRESS WITH AESTHETIC APPEARANCE

CROSS-REFERENCES

This application is a continuation of U.S. patent application Ser. No. 810,081, filed Dec. 17, 1985, which in turn was a continuation-in-part of U.S. patent application Ser. No. 591,013 filed Mar. 19, 1984, now U.S. Pat. No. 4,583,254, which are incorporated herein by reference.

BACKGROUND

The present invention relates to waterbed mattresses.

A problem with conventional waterbed mattresses is that the user does not really sleep on water. Rather, the user sleeps on polymeric material. Waterbed mattresses typically are made of an envelope having a top wall, a bottom wall, and side walls formed of a polymeric material such as polyvinylchloride. Other polymeric materials that have been suggested include polyethylene.

Mattresses are generally filled with water to about their design capacity, the depth of the water being from 8 to 9 inches. The amount of water placed in the mattress controls the "firmness" of the mattress.

When a person lies on the mattress, the top wall becomes taut and has high tension. Although the user believes he is sleeping on water, the dominant effect is produced by the taut top wall of the mattress. Although such a waterbed is more comfortable for many persons than a conventional box spring and mattress, the user is really not "floating" on water. It is believed that the lack of comfort resulting from the taut top wall has prevented some persons from using a waterbed.

Another problem with available waterbed designs is that the mattress itself has limited aesthetic appeal in the showroom. It is usually no more than flat, stretched piece of vinyl material which may have wrinkles on its top surface. This is in sharp contrast to the aesthetically pleasing and textured surface provided by the fabric on conventional mattresses. Since waterbed mattresses and conventional mattresses are often sold side-by-side in retail outlets, this is a significant competitive disadvantage for waterbed mattresses.

Another problem with available waterbed designs is how to accommodate couples of greatly different weights. When two persons of greatly different weights are on a waterbed mattress, often the heavier person forces so much of the water to the other side of the mattress that the lighter person is lying on a bulge. Another problem occurs where the persons sharing a waterbed mattress desire different firmness from the sleeping surface. To accommodate couples of different weight or couples desiring different firmnesses, there are available small size mattresses that can be placed in a single frame side-by-side. However, these side-by-side mattresses are more expensive than a single mattress, inconvenient to install, and invariably have a small gap between them.

SUMMARY

The present invention is directed to a waterbed mattress that overcomes these problems. The mattress has a polymeric top wall providing a sleeping surface, a bottom wall, and side walls. The top wall has a length and a width and a plurality of expandable folds formed therein so that the top wall stretches when a user lies on the mattress. The ratio of the surface area of the top wall when pulled taut to the surface area of the top wall when not pulled taut is at least 1.03, and generally is less than 1.3, and preferably is less than 1.2. Similarly, the ratio of the surface area of the top wall when pulled taut to the surface are of a conventional bottom wall when pulled taut is at least 1.03, and is generally less than 1.3, and is preferably less than 1.2 i.e., preferably only the top wall has the extra material. Preferably the folds are in a regular and uniform repeating pattern for aesthetic appeal.

To achieve the desired amount of stretching, preferably the folds are spaced apart from each other by a distance (L) of from about ¼ to about 4 inches, more preferably from about 1 to about 3 inches, and most preferably by about 2 inches. The ratio of the height of the folds (H) to (L) is preferably from about 1/16 to about 1, more preferably from about ⅛ to about ½, and most preferably is about ¼.

When the top wall is pulled taut, the sum of the length and width of the top wall is at least 5 inches greater, and generally no more than 20 inches greater, than the sum of the length and width of the top wall when not pulled taut, and also the sum of the length and width of the bottom wall when pulled taut. Thus, when a user lies on the mattress, he or she feels as if he or she is truly floating in water, rather than lying on a taut sleeping surface.

The folds are oriented so that stretching of the mattress occurs more easily from side-to-side than from head-to-foot. Usually a person sleeps on the mattress aligned with the length. Preferably the folds are oriented so that, when stretching occurs, the width stretches by a greater percentage than does the length.

This feeling of floating in water can best be effected by filling the mattress to less than its capacity. The mattress generally has a capacity of at least 12 inches of water. In the use of a mattress according to the present invention, the mattress contains water in an amount at least 3 inches less than its capacity. Thus, for a mattress with 12 inches of water capacity, the mattress contains no more than 8 to 9 inches of water. For a mattress with 14 inches of water capacity, the mattress contains no more than 11 inches of water.

Preferably the mattress contains a cushion for preventing bottoming of the top wall of the mattress when a user sits or lies on the mattress.

It is not necessary that the entire top surface of the mattress have folds. For example, to accommodate a couple where one member of the couple wants a firm surface and the other desires a soft surface, only half of the mattress has folds.

In addition, the amount of stretch provided by the folds can vary in different regions of the top wall of the mattress by varying the spacing between folds and the size of the folds. For example, if one member of a couple desires a low tension surface while the other member desires a firm surface, one half of the mattress can have a large number of folds spaced close to each other where the folds are generally large, while the other half of the mattress can have no folds, or a relatively small number of folds spaced a greater distance apart from each other, where the folds are of smaller size. Thus the amount of stretch on the top wall of the mattress can be varied across the width of the mattress.

Similarly the amount of stretch provided by the folds can be varied from the head to the foot of the mattress. For example, more stretch can be provided by the folds in the heavier regions of the human anatomy such as the shoulder and butt regions, while less stretch is provided in the mid-back and leg region, and even less stretch is provided in the head and feet region.

In an alternate version of the invention, folds can be provided in the side walls of the mattress to provide stretching when a user lies on the mattress. Preferably means are provided for biasing the top wall and bottom wall of the mattress together so that the stretching occurs only when the user lies on the mattress.

DRAWINGS

These and other features, aspects, and advantages of the present invention will become better understood with reference to the following description, appended claims, and accompanying drawings where:

DESCRIPTION

Figure 1:
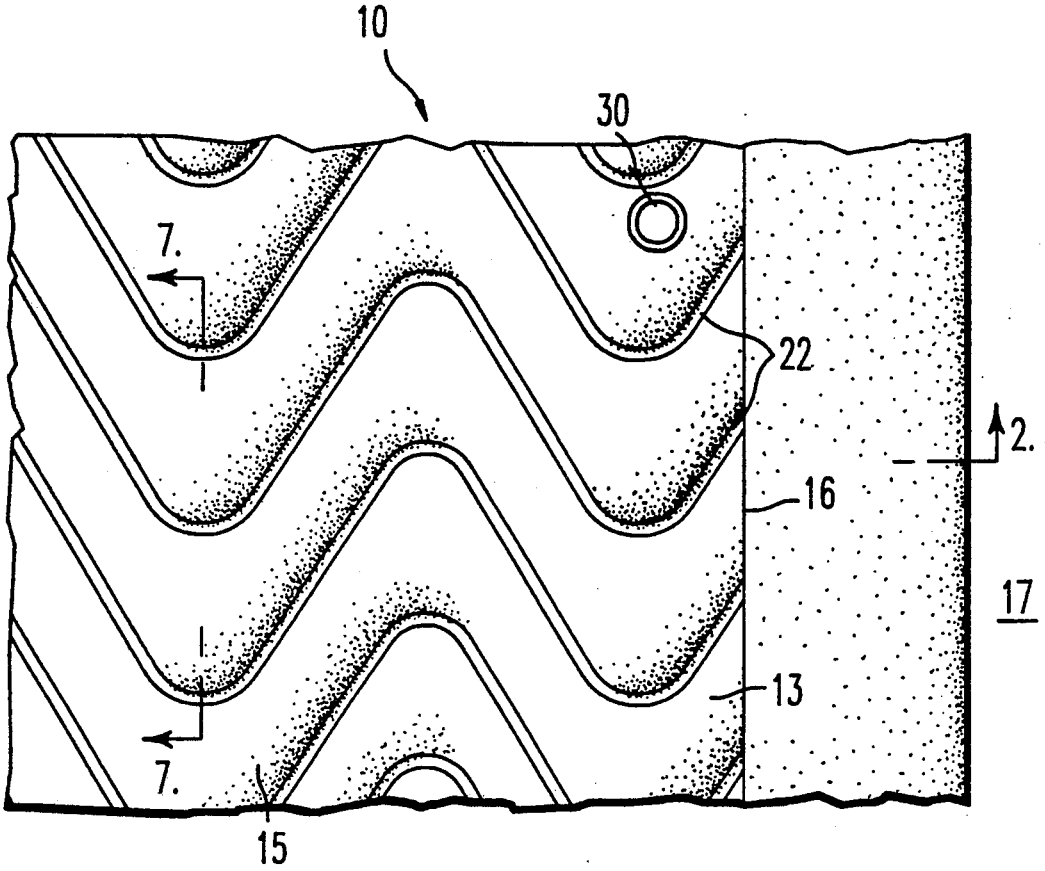
FIG. 1 is a top plan view of a portion of a waterbed having a waterbed mattress according to the present invention, the mattress having regular repeating folds molded into its top surface.
Figure 2:
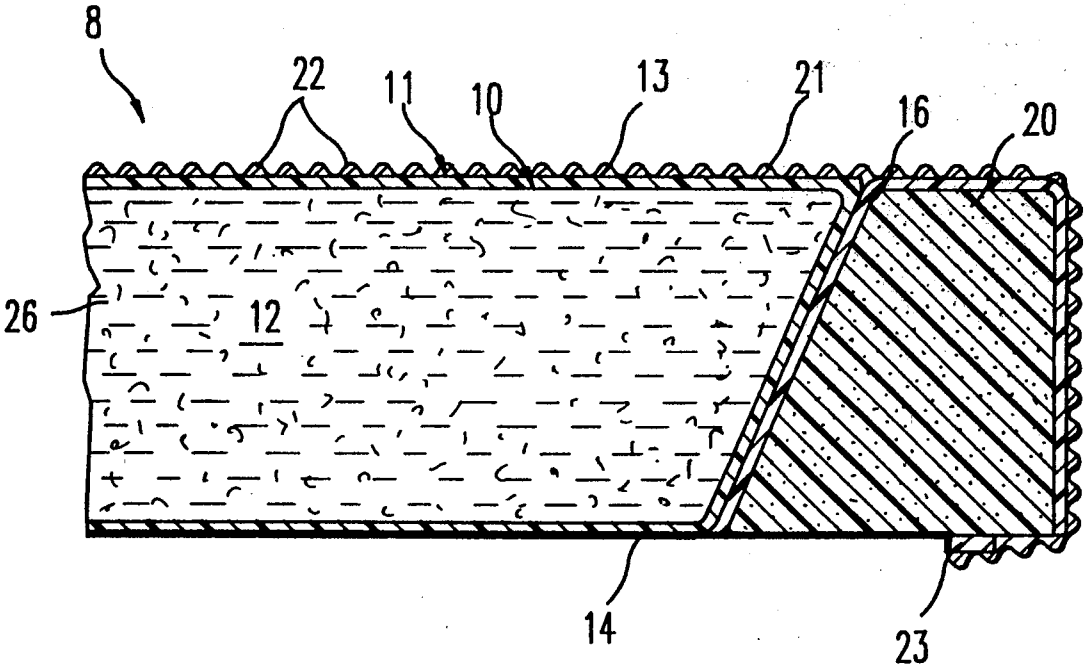
FIG. 2 is a vertical sectional view of a portion of the bed of FIG. 1, without a cover taken on line 1—1 in FIG. 1.

With reference to FIGS. 1 and 2, the present invention is directed to a waterbed 8 having a foot 17 and a waterbed mattress 10 that includes an enclosing structure 11 containing a body of water 12. The enclosing structure 11 is fabricated of a flexible polymeric material such as polyvinylchloride or polyethylene. The waterbed mattress 10 comprises a top wall 13, a bottom wall 14, and side walls 16. The top wall 13 is adapted for receiving persons in sitting and reclining positions and provides a sleeping surface of the mattress. Water can be introduced into or removed from the waterbed mattress 10 through a valve 30 in the top wall 13 near the foot 17 of the waterbed 8.

The waterbed 8 can include a frame 20 that encloses the side walls 16 of the waterbed mattress 10. The frame 20 shown in the figures is formed of a foam material such as polyurethane foam. Other types of frames can be used, such as wood frames, air frames, and plastic frames. Generally the height of the frame 20 is about equal to the height of the filled waterbed waterbed 8 10. The mattress can also be provided with a liner underneath the mattress and between the foam frame 20 and the waterbed mattress 10. For simplicity, the liner is not shown in the figures.

The waterbed 8 can be provided with a cover 21 that extends over the waterbed mattress 10 and the frame 20. The cover 21 is tucked under the frame 20 and is held in place by hook and loop type fasteners 23 such as the one sold under the trademark Velcro.

The top wall 13 of the waterbed mattress 10 has a plurality of folds 22 molded therein. By the term "folds" we mean a part of the top wall 13 that is doubled or laid over another part, including pleats, shirring, puckers, and gathers.

The folds 22 are expandable so that the top wall 13 stretches when a user lies on the waterbed mattress 10. Preferably sufficient expansion is provided so that the ratio $R_1$ of the surface area of the top wall 13 when pulled taut to the surface area of the top wall 13 when not pulled taut is at least 1.03, and preferably at least 1.05. By the term "pulled taut" we mean that the top wall 13 or bottom wall 14 is subjected to a pulling force of 10 pounds. At a ratio of greater than 1.03, a person lying on the mattress feels as if he or she is actually floating in water, rather than being supported by the top wall of the mattress.

Preferably the ratio $R_1$ is less than about 1.5 because bottoming out can occur i.e., the top wall 13 can come into contact with the bottom wall 14. Also, at ratios $R_1$ greater than about 1.5, it is difficult to form folds 22 that are aesthetically pleasing. Further, the user can end up sleeping on wrinkles, which can be uncomfortable. More preferably, the ratio $R_2$ is less than about 1.3, and most preferably less than about 1.2, and optimally between about 1.05 and 1.1.

Generally the same values apply for ratios $R_2$ of the surface area of the top wall 13 to the surface area of the bottom wall 14 because generally there is no reason to provide excess material in the bottom wall 14. Thus, preferably sufficient expansion is provided that the ratio $R_2$ of the surface area of the top wall 13 when pulled taut to the surface area of the bottom wall when pulled taut is at least 1.03, and preferably at least 1.05. Likewise, preferably the ratio $R_2$ is less than about 1.5, more preferably less than about 1.3, and most preferably less than about 1.2, and optimally between about 1.05 and 1.1.

The sum of the length and width of the top wall 13 due to the folds 22 is at least 5 inches greater than the sum of the length and width of the top wall 13 when not pulled taut (also 5 inches greater than the sum of the length and width of the bottom wall 14 when pulled taut). Generally the sum of the length and the width of the top wall 13 is no more than 20 inches preferably no more than 10 inches, greater than the sum of the length and the width of the top wall 13 when not pulled taut, and also the sum of the length and width of the bottom wall 14 when pulled taut.

When calculating the sum of the length and the width of a wall of a mattress, each dimension is added once. For example, the sum of the width and length of a mattress 96 inches long by 84 inches wide is 180 inches.

The folds 22 are formed into a pattern that is expandable and aesthetically pleasing. A large number of patterns can be used. For example, as shown in FIG. 1, a curvilinear repeating pattern where each fold 22 has a wave-like configuration can be used.

Figure 7:
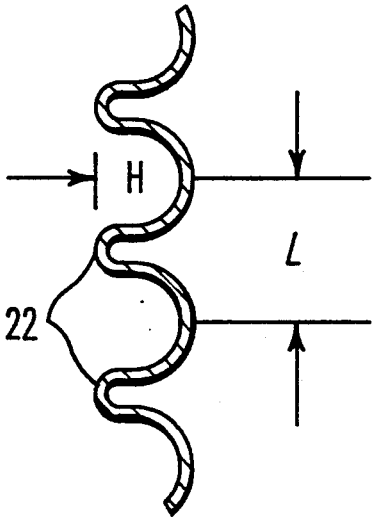
FIG. 7 is another vertical sectional view taken on line 7—7 of FIG. 1 of the mattress of FIG. 1 showing the details of the folds.

With reference to FIG. 7, the folds 22 of FIG. 1 are spaced apart from each other by a distance L, and each fold 22 has a height H, where H is the vertical distance from the top of one fold 22 to the trough of an adjacent fold—i.e., twice the amplitude of each fold 22. To achieve the desired stretching, preferably L is from about ¼ inch to about 4 inches, more preferably from about 1 to about 3 inches, and most preferably about 2 inches, while the ratio $R_3$ of H to L is preferably from about 1/16 to about 1, more preferably from about ⅛ to about ½, and most preferably about ¼. In the version of FIG. 1, L is 2 inches and H is ½ inch.

Preferably the cover 21 stretches an amount about the same as the waterbed mattress 10 stretches. Otherwise, benefits obtained from the stretchable waterbed mattress 10 are not realized because the use of the waterbed mattress 10 feels as if he is sleeping on a taut cover.

As shown in FIG. 1, preferentially the folds 22 are oriented so that stretching of the waterbed mattress 10 preferentially occurs side-to-side rather than from head-to-foot. In use of a mattress, generally there is more need for side-to-side stretching, particularly where two people are sleeping on the mattress 10.

Figure 3:
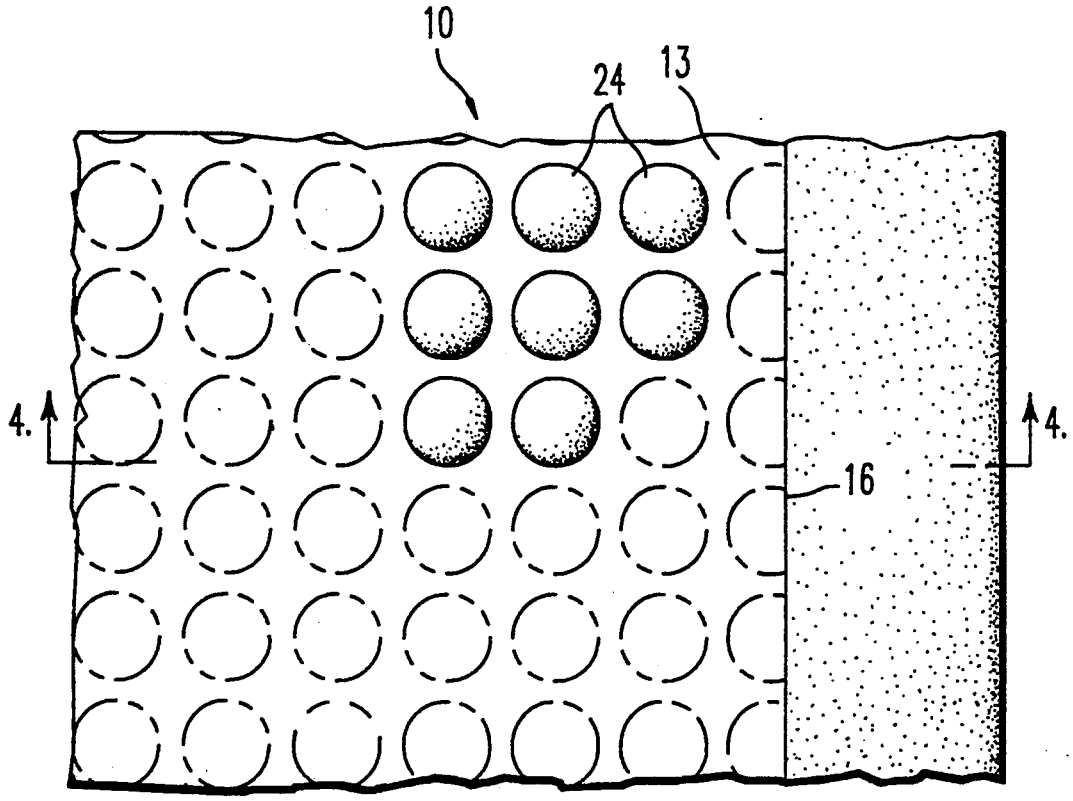
FIG. 3 shows another version of a waterbed having a mattress according to the present invention, the mattress having regular repeating folds molded into its top surface.

In the version of the invention shown in FIG. 3, folds 24 are in the shape of circular bumps or raised portions. As shown in FIGS. 1 and 3, it is desirable that the folds 22 and 24 be in a regular, uniform repeating pattern so that the expansion of the top wall 13 of the waterbed mattress 10 occurs uniformly across its surface and so that the appearance of the top wall 13 is attractive.

A variety of other shapes can be used, including curled, looped, swirled, curlique, quilted, box, rectangular, and triangular patterns.

Preferably the waterbed mattress 10 is provided with an internal structure to avoid bottoming out, particularly when the ratio $R_2$ of the surface area of the top wall 13 to the bottom wall 14 is large. A variety of structures conventionally used for baffling can be provided. For example, as shown in FIG. 2, the inside of the waterbed mattress 10 can be provided with fiber material 26. The use of fiber in a mattress is described in U.S. Pat. No. 4,301,560 issued to Fraige.

Figure 4:
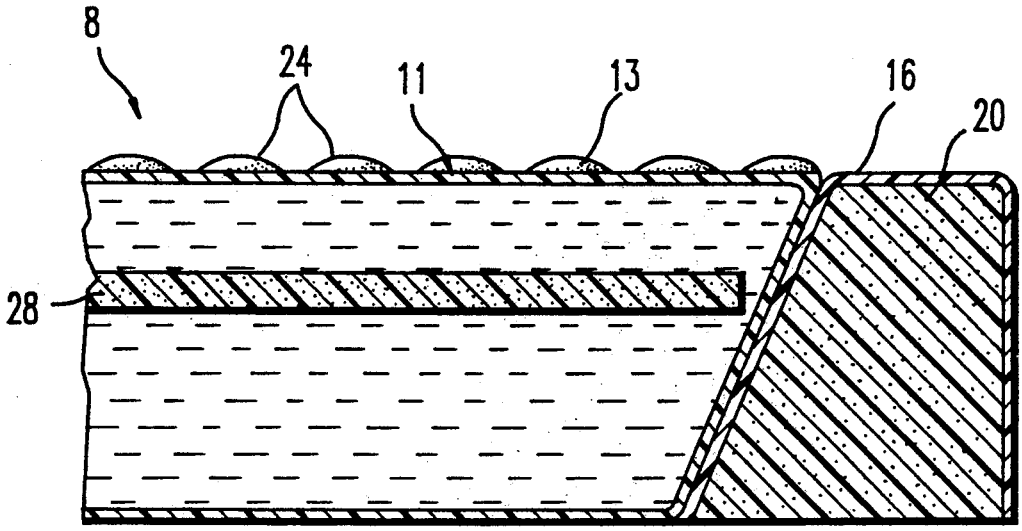
FIG. 4 is a vertical sectional view of a portion of the bed of FIG. 3 taken along line 4—4 in FIG. 3.

In FIG. 4 there is shown a baffle structure comprising a horizontal, floating piece of foam 28 as described in U.S. Pat. No. 4,345,348 issued to Charles P. Hall, which is incorporated herein by this reference.

Preferably the waterbed mattress 10 is not filled to capacity. By the term "capacity", we mean the amount of water in the waterbed mattress 10 when the center of the waterbed mattress 10 becomes higher than that portion of the mattress 4 inches from the side—i.e., when a crowning effect first occurs. Normally waterbed mattresses have an 8 to 9 inch capacity. That is, when the mattress is filled to capacity, its height is about 8 inches. Likewise, the frames 20 provided for the mattress generally are about 8 to 9 inches in height.

A waterbed mattress 10 according to the present invention has a capacity at least about 3 inches greater than the amount of water in the mattress. A mattress designed to fit into a conventional frame has a capacity of at least 11 to 12 inches and when used would contain about 8 to 9 inches of water to obtain a feeling of floating in water. Preferably the capacity of the mattress is about 6 inches greater than the amount of water in the mattress. For example, a mattress filled to thickness of about 8½ to 9½ inches has a capacity of 14 inches or greater. Preferably the capacity is no more than about 9 inches greater than the amount the mattress is to be filled to avoid bottoming out in use.

The enclosing structure 11 can be formed in any suitable manner. Preferably it is formed by bonding two planar sheets together along their peripheries or by bonding two upstanding sheets between the edges of the top and bottom walls to form a contour or fitted structure.

To obtain the folds 22 in the top wall 13 of the waterbed mattress 10, preferably the top wall 13 is vacuum molded. In vacuum forming the top wall 13, the vinyl material is heated until it softens, generally to a temperature of about 250° F. Preferably high molecular weight vinyl is used to take the set required to form the folds 22. Preferably the top wall 13 is formed from thicker vinyl than the remaining portion of the waterbed mattress 10 to accommodate the folds 22. For example, the top wall 13 can be formed from 25 mil thick (0.025 inch) vinyl, while the bottom wall 14 is formed from a sheet of 20 mil thick vinyl. The folds 22 can also be formed by extruding the waterbed mattress 10.

Figure 8:
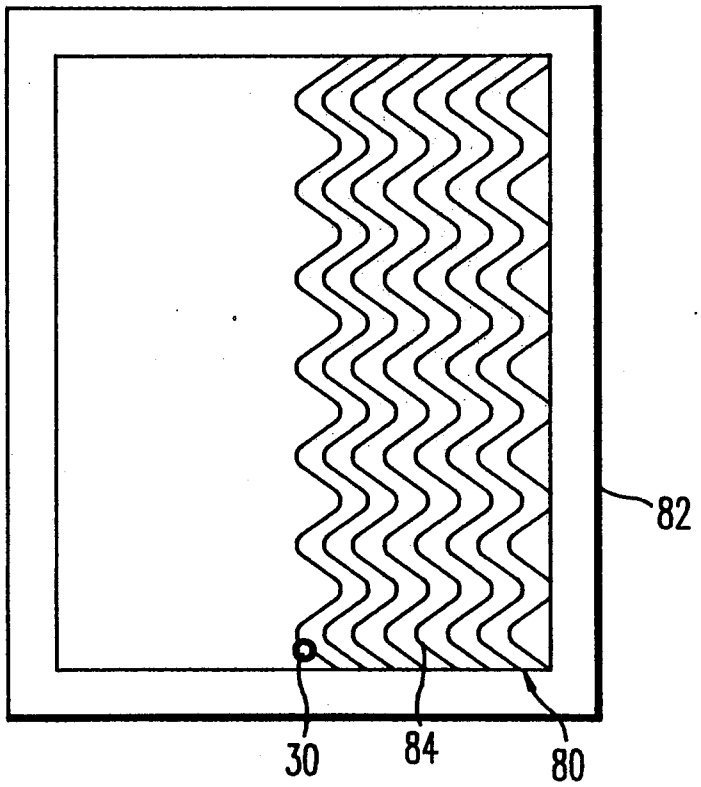

In the version of the invention shown in FIG. 8, a mattress 80 with a fill/drain valve 30 is enclosed by a frame 82. Only a portion of the surface of the mattress 80 has folds 84 formed therein namely, the right side of the mattress 80. This allows a single mattress to be used for a person who desires a firm mattress (the left side) and for a person who desires a soft, low tension mattress (the right side).

Figure 9:
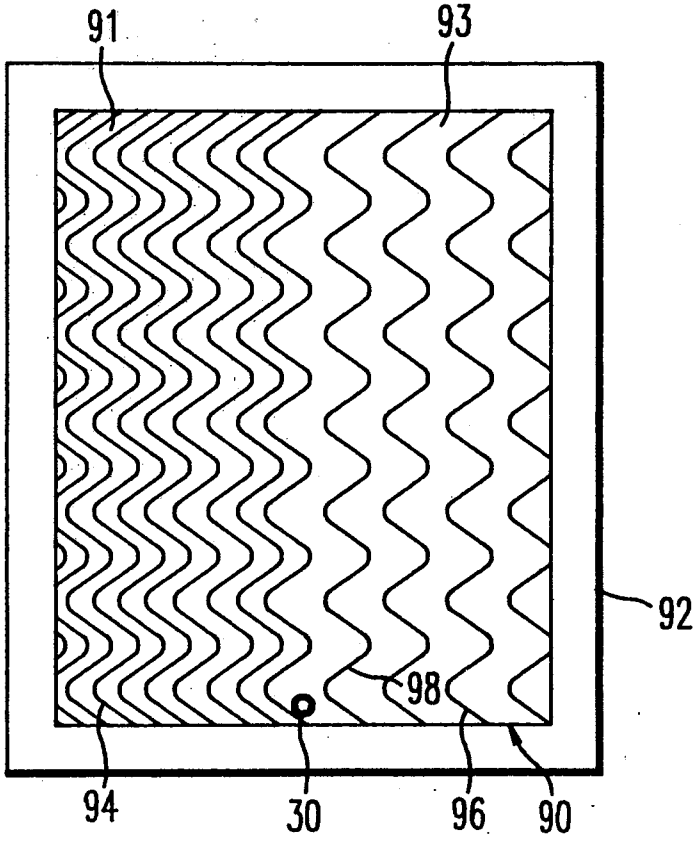
FIGS. 8–11 each show a top plan view of a different version of a waterbed mattress according to the present invention.

FIG. 9 shows a mattress 90 similar to the mattress 80 of FIG. 8. In FIG. 9, the mattress 90 with a fill/drain valve 30 is enclosed by a frame 92. The top wall of the mattress 90 has a left region 91, a right region 93, and a central region 98. The left region 91 has a plurality of relatively large, closely spaced folds 94, while the right region 93 has a plurality of smaller, further spaced apart folds 96. Thus, there is more stretch in the left region 91 than in the right region 93. Preferably the central region 98 has an amount of stretch intermediate the stretch of the left region 91 and the right region 93, so that there is not an abrupt change in the amount of stretch. The left region 91 of the mattress with the folds 94 is better adapted for a person who likes a relatively soft, low tension mattress, while the right region 93 is better adapted for a person who likes a stiffer, more firm sleeping surface.

Figure 10:
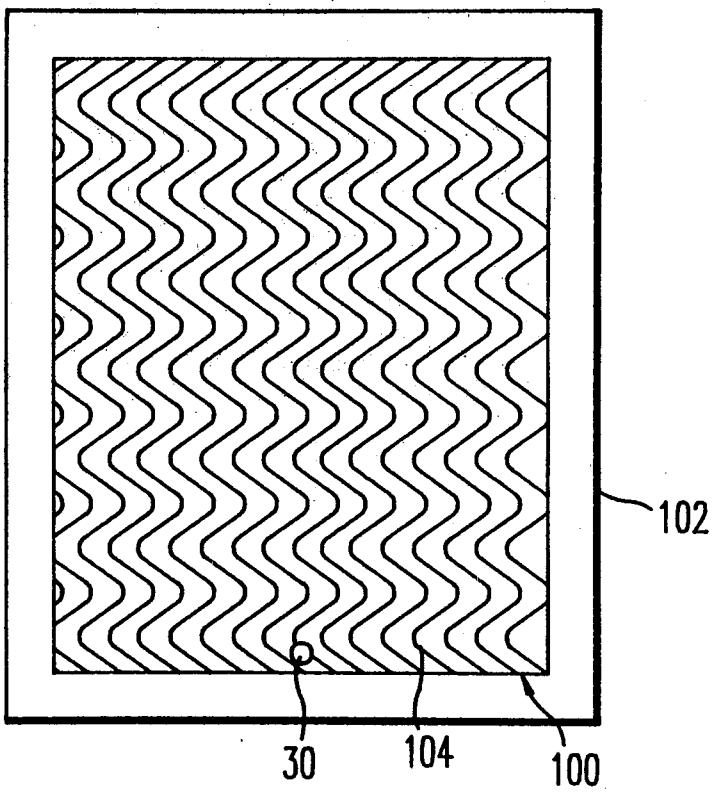

FIG. 10 shows another version of the present invention where a mattress 100 having a fill/drain valve 30 is surrounded by a frame 102. The mattress 100 has a plurality of folds 104 on its top surface. Along the left side of the drawing there are identified different regions of the mattress 100 that correspond to different portions of the body (namely, head, shoulder, mid-back, butt and lower back, legs, and feet regions). The amount of stretch built into the top wall of the mattress 100 by the folds 104 is controlled by the number of folds and/or size of the folds 104 in the different regions. For example, the most stretch is available in the shoulder region and butt and lower back region, with the least amount of stretch is available in the head region and the feet region. Intermediate stretch is available in the mid-back region and the leg region.

The size of the regions is chosen to conform to the general human anatomy. For example, for a standard seven foot mattress, the length of the head, shoulder, mid-back, butt and lower back, leg, and feet regions can be 1 foot, 1 foot, 1 foot, 1½ feet, 1½ feet, and 1 foot respectively.

Figure 11:
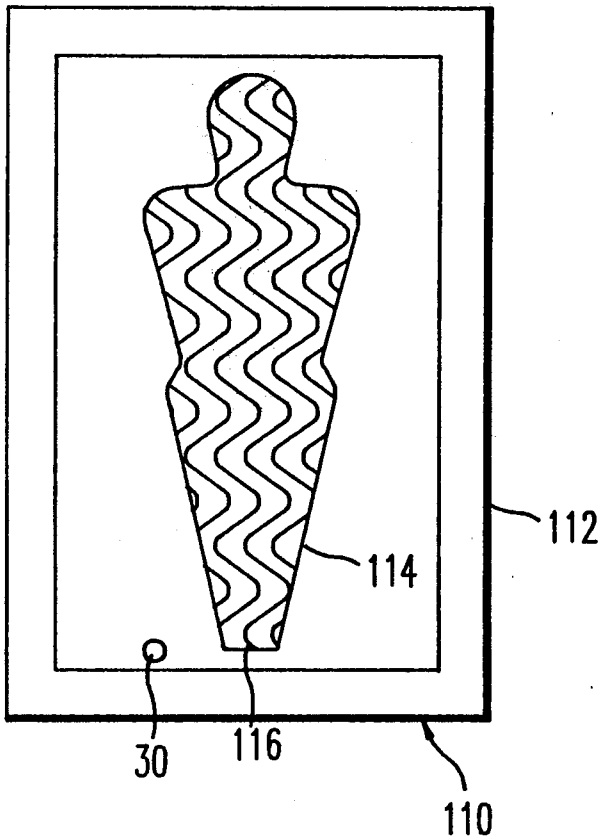

In the version of the invention shown in FIG. 11, a mattress 110 having a fill/drain valve 30 is surrounded by a frame 112. The mattress 110 has formed in its top surface a region 114 of folds 116, where the region 114 of folds 116 conforms to the human anatomy. A mattress can also be provided with two such regions 114 of folds 116 conforming the human anatomy. Thus, in this version the region of stretching is limited to that which is actually needed by a particular user. The mattress 110 provides a "cocooning" effect, which can be very pleasurable.

It should be realized that the variations of the invention shown in FIGS. 8–11 can be combined in a single mattress. For example, the head-to-foot variation in stretchability of the mattress shown in FIG. 10 can be superimposed on the side-to-side variations in stretchability of the mattresses shown in FIGS. 8, 9, and 11. That is, a mattress can be formed so that the stretchability of the top surface varies not only from side-to-side, but also from head-to-foot.

Figure 5:
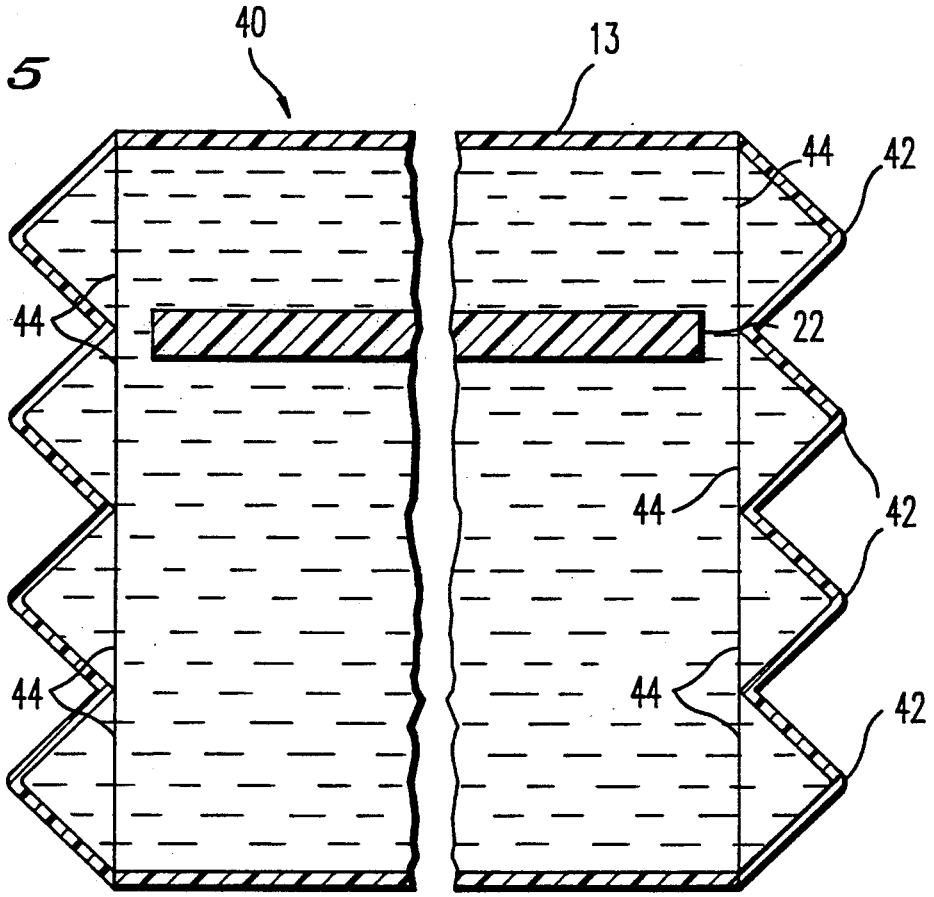
FIG. 5 is a vertical sectional view of another version of a mattress according to the present invention where folds are molded into the side wall of the mattress.
Figure 6:
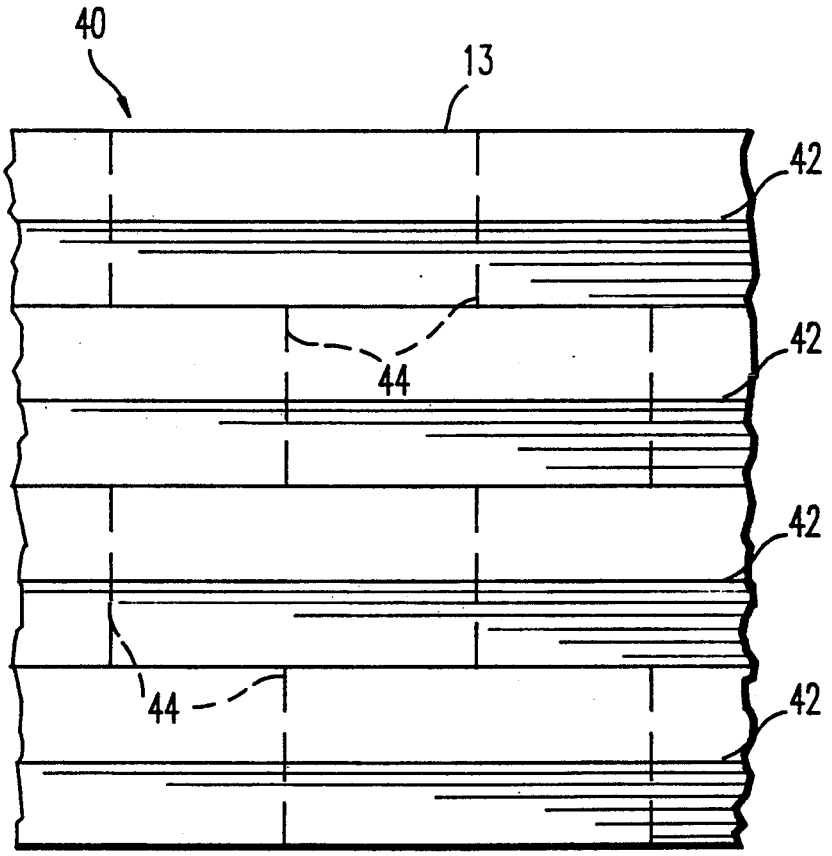
FIG. 6 is a side elevation view of the mattress of FIG. 5 taken on line 6—6 in FIG. 5.

In an alternate version of the present invention, rather than providing the folds in the top wall, the folds can be provided in the side walls, as shown in FIGS. 5 and 6. In the mattress 40 shown in FIGS. 5 and 6, there are a plurality of folds 42 in the side walls, giving an accordion-like appearance. To avoid sagging when a user is not on the mattress, internal elastic ties 44 are provided which pull the folds toward each other and pull the top and bottom walls toward each other. The internal elastic ties 44 can be made of a polymeric synthetic rubber material that can be heat welded or bonded by adhesive to the mattress. A suitable material is Neoprene rubber. The internal elastic ties 44 maintain the mattress 40 in a generally box-like configuration when someone is not lying on the mattress, but they allow the folds 42 to expand without excessive resistance when weight is placed on the top wall 13 of the mattress 40. If desired, external elastic ties can be used in place of or in addition to the internal elastic ties 44.

The mattress of the present invention has significant advantages. Not only is it aesthetically pleasing, it provides a true feeling of "floating" in water. Further, excessive pressure on the person sleeping is avoided. Moreover, when two persons of different weights are sleeping on the mattress, due to the high compliance and stretchability of the pleated top surface, the lighter person is not pulled into a "valley" formed by the heavier person.

Although the present invention has been described in considerable detail with reference to certain preferred versions thereof, other versions are possible. For example, a mattress having folds in both the top wall and the side wall can be provided. Therefore, the spirit and scope of the appended claims should not necessarily be limited to the description of the preferred versions contained herein.

What is claimed is:

1. A waterbed mattress having a polymeric top wall providing a sleeping surface, a bottom wall, and side walls, and first and second portions of the top wall being more stretchable than the remainder of the top wall, the shape of each portion of increased stretchability conforming generally to the human anatomy with one portion of increased stretchability on each side of the mattress, the ratio of the surface area of each portion of increased stretchability when pulled taut to the surface area of that portion of increased stretchability when not pulled taut being at least 1.05, the portions of increased stretchability having a plurality of expandable folds formed therein so that the portions of increased stretchability stretch when a user lies on the mattress.

2. The mattress of claim 1 wherein the folds in the first portion of increased stretchability are larger in height and spaced closer together than the folds in the second portion of increased stretchability, and wherein the first portion of increased stretchability is more stretchable than the second portion of increased stretchability.

3. The mattress of claim 2 wherein each portion of increased stretchability comprises at least two regions of differing stretchability.

4. The mattress of claim 3 wherein there is a third portion of increased stretchability, the third portion of increased stretchability having a plurality of expandable folds formed therein, the third portion of increased stretchability having a stretchability intermediate the stretchability of the first and second portions of increased stretchability so that there is a continuous and gradual change in the amount of stretchability from one side of the mattress to the other.

5. The mattress of claim 1 wherein the mattress has a length and a width, and wherein the stretchability of the top wall varies along the length of the mattress.

6. The mattress of claim 1 wherein the mattress has a length and a width, and wherein the stretchability of the top wall varies along the width of the mattress.

7. The mattress of claim 1 wherein the mattress has a length and a width, and wherein the stretchability of the top wall varies along both the width and the length of the mattress.

8. The mattress of claim 3 wherein there are regions in each portion of increased stretchability which correspond generally to the different regions of the body of a user of the mattress, namely the had, shoulder, mid-back, lower back, butt, legs, and feet regions, wherein the stretchability of the regions corresponding to the shoulder, lower back, and butt regions are greater than the stretchability in the mid-back and leg regions, and the stretchability in the mid-back and leg regions are greater than that in the head and feet regions.

9. The mattress of claim 8 wherein the size of the various regions of the portions of increased stretchability correspond generally to the general human anatomy.

10. The mattress of claim 9 wherein the lengths of the regions corresponding to the head, shoulder, mid-back, butt and lower back, leg, and feet region are about 1 foot, 1 foot, 1 foot, 1.5 feet, 1.5 feet, and 1 foot, respectively.

11. A waterbed comprising a frame and within the frame a waterbed mattress having a polymeric top wall providing a sleeping surface, a bottom wall, and side walls, and two portions of the top wall being more stretchable than the remainder of the top wall, the shape of each portion of increased stretchability conforming to the human anatomy, one portion of increased stretchability on each side of the mattress, the ratio of the surface area of each portion of increased stretchability when pulled taut to the surface area of the portion of increased stretchability when not pulled taut being at least 1.05, the portions of increased stretchability having a plurality of expandable folds formed therein so that the portions of increased stretchability stretch when a user lies on the mattress.

12. The waterbed of claim 11 including a stretchable cover.

13. The waterbed of claim 12 in which the cover stretches in an amount about the same as the top wall of the mattress stretches.

14. The waterbed of claim 11 wherein a portion of the top wall of the mattress is substantially non-stretchable.

15. A waterbed mattress having a polymeric top wall providing a sleeping surface, a bottom wall, and side walls, and first and second portions of the top wall being more stretchable than the remainder of the top wall, the ratio of the surface area of each of the portions of increased stretchability when pulled taut to the surface are of that portion of increased stretchability when not pulled taut being at least 1.05, the portions of increased stretchability having a plurality of expandable folds formed therein so that the portions of increased stretchability stretch when a user lies on the mattress, the portions of increased stretchability comprising regions of differing stretchability, the portions of increased stretchability together having a shape generally conforming to the shape of the human anatomy.

16. The mattress of claim 15 wherein the portions of increased stretchability on the top wall correspond generally to the different regions of the body of the user of the mattress, namely the head, shoulder, mid-back, lower back, butt, legs, and feet regions, wherein the stretchability of the regions corresponding to the shoulder, lower back, and butt regions are greater than the stretchability of the regions corresponding to the mid-back and leg regions, and the stretchability of the regions corresponding to the mid-back and leg regions are greater than that in the head and feet regions.

17. A waterbed comprising a frame and within the frame a waterbed mattress having a polymeric top wall providing a sleeping surface, a bottom wall, and side walls, at least first and second portions of the top wall being more stretchable than the remainder of the top wall, the ratio of the surface area of each of the portions of increased stretchability when pulled taut to the surface area of that portion of increased stretchability when not pulled taut being at least 1.05, the portions of increased stretchability having a plurality of expandable folds formed therein so that the portions of increased stretchability stretch when a user lies on the mattress, the portions of increased stretchability comprising regions of differing stretchability, the portions of increased stretchability together having a shape generally conforming to the shape of the human anatomy.

18. A waterbed comprising a frame and within the frame a waterbed mattress having a polymeric top wall providing a sleeping surface, a bottom wall, and side walls, and first and second portions of the top wall being more stretchable than the remainder of the top wall, the ratio of the surface area of each of the portions of increased stretchability when pulled taut to the surface area of that portion of increased stretchability when not pulled taut being at least 1.05, the portions of increased stretchability having a plurality of expandable folds formed therein sot hat the portions of increased stretchability stretch when a user lies on the mattress, the portions of increased stretchability comprising regions of differing stretchability, the portions of increased stretchability together having a shape generally conforming to the shape of the human anatomy.

19. The waterbed of claim 17 or 18 wherein the mattress has a length and a width, and wherein the stretchability of the top wall varies along the width of the mattress.

20. The waterbed of claim 17 or 18 wherein the mattress has a length and a width, and wherein the stretchability of the top wall varies along the length of the mattress.

21. The waterbed of claim 17 or 18 wherein the mattress has a length and a width, and wherein the stretchability of the top wall varies along both the width and the length of the mattress.

22. The waterbed of claim 17 or 18 including a stretchable cover for the mattress.

23. A waterbed mattress having a polymeric top wall providing a sleeping surface, a bottom wall, and side walls, at least first and second portions of the top wall being stretchable, the ratio of the surface area of each of the stretchable portions when pulled taut to the surface area of that stretchable portion when not pulled taut being at least 1.05, the stretchable portions having a plurality of expandable folds, at least a portion of the folds being in a regular repeating pattern spaced apart from each other by a distance, L, of from about $\frac{1}{4}$ to about 4 inches, the ratio of the height of the regularly repeating folds to L being from about $\frac{1}{8}$ to about $\frac{1}{2}$, wherein substantial regions of the first and second portions have different stretchabilities from each other.

24. A waterbed mattress having a polymeric top wall providing a sleeping surface, a bottom wall, and side walls, and at least first and second stretchable regions in the top wall having a plurality of expandable folds formed therein so that the stretchable regions stretch when a user lies on the mattress, the ratio of the surface area of each stretchable region when pulled taut to the surface area of that stretchable region when not pulled taut being at least 1.05, the stretchable regions being disposed in the top wall so as to correspond to a human body lying upon the mattress, and the first stretchable region having greater stretchability than the second stretchable region.

25. The waterbed mattress defined in claim 24 wherein the first and second stretchable regions of the top wall correspond to the butt and head, respectively, of a human body lying on the mattress.

26. The waterbed mattress of claim 24 or 25 wherein the top wall has a length and a width, the length being greater than the width, and wherein the folds are formed into the top wall of the mattress so that the width of the stretchable regions increases by a greater percentage than the length of the stretchable regions when a user lies on the mattress aligned with the length of the top wall.

27. The waterbed mattress of claim 26 wherein the folds of the first stretchable region are more closely spaced together than the folds of the second stretchable region.

28. A waterbed mattress having a polymeric top wall providing a sleeping surface, a bottom wall, and side walls; the top wall having at least first and second stretchable regions comprising a plurality of expandable folds disposed so that the stretchable regions stretch when a user lies on the mattress; the ratio of the surface area of each stretchable region when pulled taut to the surface area of that stretchable region when not pulled taut being at least 1.05, the first and second stretchable regions being disposed in the top wall so as to correspond to the butt and head, respectively, of a human body lying on the mattress; the top wall having a length and a width, the length being greater than the width, and the folds being formed into the top wall so that the width of the stretchable regions increases by a greater percentage than the length of the stretchable regions when a user lies on the mattress aligned with the length of the top wall; and wherein the folds of the first stretchable region are more closely spaced together than the folds of the second stretchable region, so that the first region has more stretchability than the second region.

29. In a waterbed mattress including an elongated top sheet having head and foot ends, a bottom sheet and side walls defining a fluid-tight receptacle, the improvement comprising, said top sheet including a plurality of elongated depressions and riser portions formed therein and arranged to impart extensibility to said top sheet, said depressions and riser portions being arranged in a non-uniform distribution across the surface of said top sheet so that the extensibility of said top sheet varies at different positions therealong.

* * * * *